United States Patent [19]

Marinoni

[11] Patent Number: 4,977,642

[45] Date of Patent: Dec. 18, 1990

[54] DOOR MOUNTING WITH SIDE OPENING FOR INSERTION OF PIVOT PIN

[75] Inventor: Mario Marinoni, Magenta, Italy

[73] Assignee: Casma S.p.A., Magenta, Italy

[21] Appl. No.: 308,015

[22] Filed: Feb. 9, 1989

[30] Foreign Application Priority Data

Feb. 26, 1988 [DE] Fed. Rep. of Germany ..... 3806199

[51] Int. Cl.[5] ..... E05D 7/10; E05D 7/12

[52] U.S. Cl. ..... 16/257; 16/272; 16/379

[58] Field of Search ..... 16/257, 259, 252, 357, 16/361, 254, 258, 262, 272, 379

[56] References Cited

U.S. PATENT DOCUMENTS 3,222,711 12/1965 Cecala ..... 16/272
3,651,538 3/1972 Jentsch ..... 16/134
3,828,394 8/1974 Horgan, Jr. ..... 16/129
4,689,853 9/1987 Marinoni ..... 16/382

FOREIGN PATENT DOCUMENTS 0282809 9/1988 European Pat. Off. .
957634 2/1957 Fed. Rep. of Germany .
7105662 2/1971 Fed. Rep. of Germany .
8404254 5/1984 Fed. Rep. of Germany .
1242558 8/1971 United Kingdom .

*Primary Examiner*—Richard K. Seidel
*Assistant Examiner*—Carmine Cuda
*Attorney, Agent, or Firm*—Foley & Lardner, Schwartz, Jeffery, Schwaab, Mack, Blumenthal & Evans

[57] ABSTRACT

The invention relates to a door, especially an all glass door, with a bearing recess provided which extends perpendicularly to a vertical edge of the door. The bearing recess has a side opening for the insertion of pivot pin at the end which is closest to the vertical edge.

11 Claims, 3 Drawing Sheets

DOOR MOUNTING WITH SIDE OPENING FOR INSERTION OF PIVOT PIN

BACKGROUND OF THE INVENTION

The present invention relates to a door mounting with fixed pivot pin, which mounting accommodates installation of a door without the need for excessive tilting or clearances.

In known doors, especially in all glass doors, the bearing recess for accepting the pivot pin is enclosed on all sides so that the door has to be placed onto the pivot pin. This necessitates a tilting movement of the door during installation. Such a tilting movement requires a significant height clearance.

For example, with soffits or transoms which are wider than 60 mm, the height clearance has to be larger than the normal height clearance of 10 mm. Since a height clearance of more than 10 mm is often undesirable, a special lower door mounting, typically comprising a two-part insert in the fitting, has to be used to obviate the need for a tilting movement.

SUMMARY OF THE INVENTION

It is therefore an object of the present invention to permit the mounting of a door on a pivot pin without the need for a tilting movement of the assembly.

It is another object of the present invention to provide a door mounting that can be installed without exceeding the normal height clearances for doors.

Yet another object of the present invention is to allow for the mounting of a door without the need for a specialized insert.

In accomplishing the foregoing objects, there has been provided, in accordance with one aspect of the present invention, a door mounting comprising a fitting member for receiving a vertical edge of a door, the fitting member having a first recess; an insert member provided within the first recess, the insert member having a second recess that is accessible via openings provided, respectively, in a vertical wall and a horizontal wall of the insert member, wherein the second recess is configured to receive a pivot pin such that the pivot pin can move horizontally within the insert member; and an abutment member provided on a wall of the insert member, a portion of the abutment member extending into the second recess through an opening in the vertical wall of the insert member. In a preferred embodiment, the door mounting of the present invention further comprises a pivot pin inserted into the second recess, whereby the portion of the abutment moves from an initial position upon insertion of the pivot pin through the opening in the vertical wall of the insert member, the portion returning to its initial position after insertion to secure the pivot pin within said second recess.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
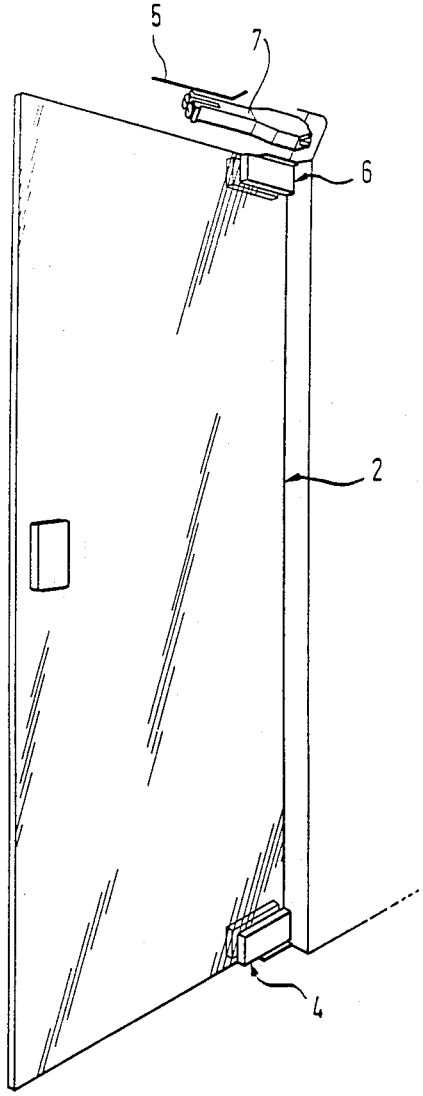
FIG. 1 is a line drawing that shows an all-glass door installed with a lower swivel mounting, constructed according to the present invention, and a conventional upper swivel fitting.

A door mounting within the present invention allows for the mounting of a door without excessive fitting or clearance on a pivot pin. The door mounting of present invention includes a fitting that receives the door and an insert having a recess. This recess is accessible to the pivot pin via an opening extending along a vertical wall of the insert and along a horizontal wall of the insert. The recess is configured to allow the pin to move horizontally within the recess. Thus, the door and door mounting may easily be installed upon the pivot pin by introducing the pivot pin into the recess via the opening and sliding the door and mounting horizontally relative to the pin. An abutment member is provided to prevent the pivot pin from exiting the recess. This door mounting is especially advantageous when used for all-glass doors which have a tubular frame door-closer mounted in the upper transom.

In the following description, and in the accompanying drawings, like reference numerals refer to like features or elements among the various figures and embodiments.

With reference to FIG. 1, a door 2 having a lower swivel mounting 4 according to the invention and a conventional upper swivel fitting 6 is seen. This door 2 has a tubular frame door-closer 7 mounted in an upper transom 5. Door 2 may be constructed entirely of glass.

Figure 2:
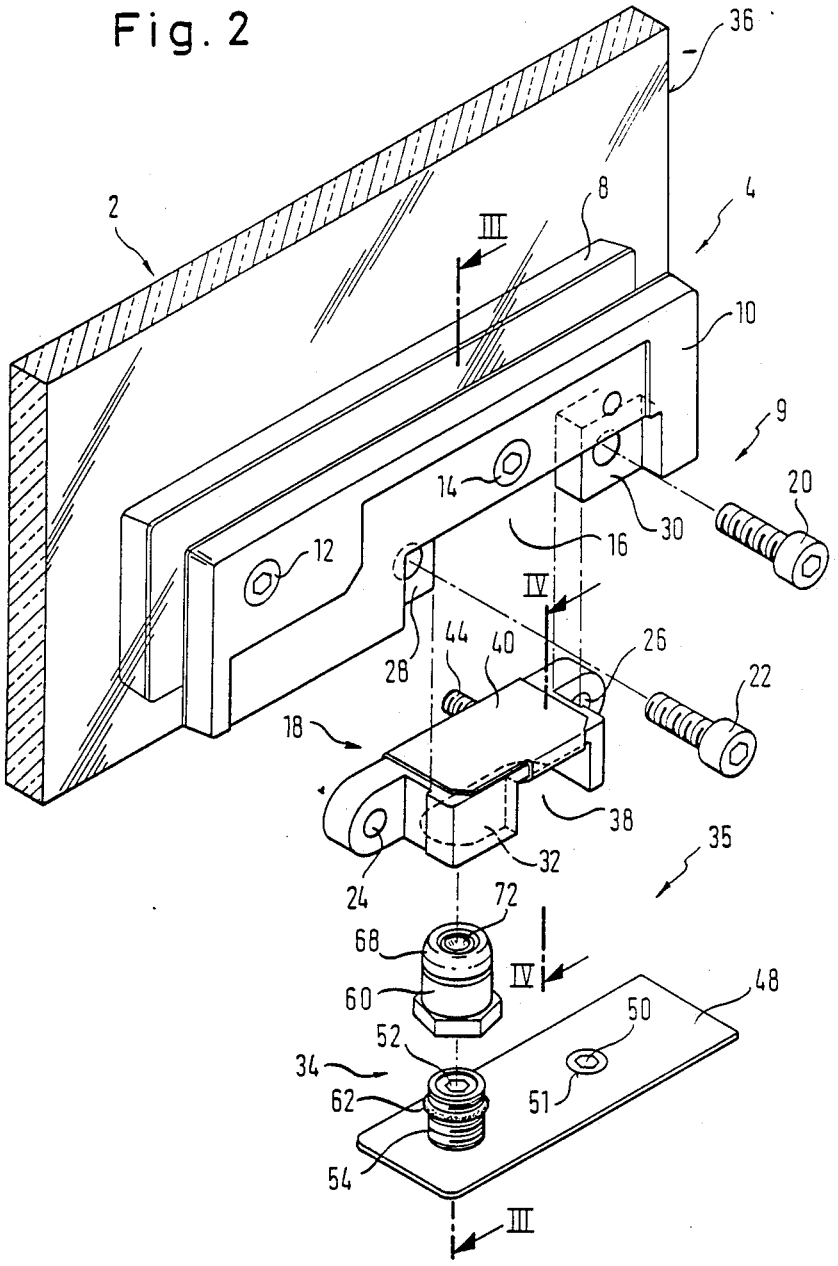
FIG. 2 is an exploded illustration of the lower swivel mounting in its interaction with the pivot pin.
Figure 3:
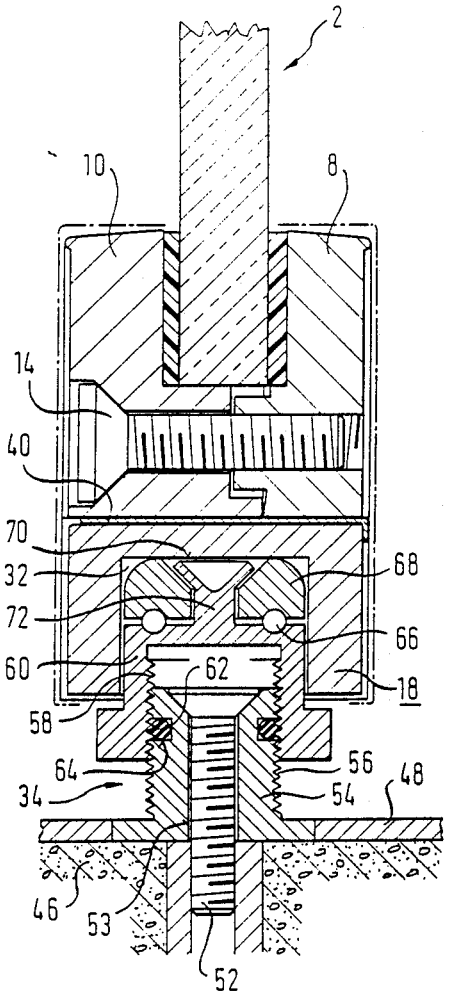
FIG. 3 is a line drawing depicting a section, taken along line III—III in FIG. 2, of the swivel mounting installed on a pivot pin.

In FIG. 2, a lower swivel mounting 4 is formed by a strap member 9 having two plates 8 and 10 which are disposed on either side of the door 2 and connected to each other by screws 12 and 14. The plates 8 and 10 have on their underside a recess 16 for the accommodation of a unitary insert 18 which is secured in the recess 16. For this purpose the screws 20 and 22 penetrate holes 24 and 26 in the insert 18 and engage the internal thread in projections 28 and 30 of the plates 8 and 10.

The insert 18 has a bearing recess 32 to receive a fixed pivot pin 34. The bearing recess 32 extends perpendicularly to the vertical edge 36 of the all-glass door 2 and has an opening 38 for the insertion of the pivot pin 34 at the end of recess 32 which is closer to the vertical edge 36. Opening 38 allows door 2 to be placed upon pivot pin 39 without tilting the door 2.

Figure 4:
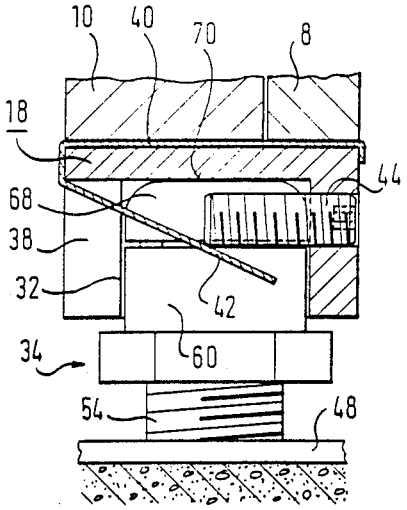
FIG. 4 is a line drawing that shows a section along line IV—IV in FIG. 2.

The insert 18 is on its upper side enveloped by a sheet 40. Referring to FIG. 4, sheet 40 has a resilient downwardly inclined tongue 42 which projects into the opening 38. When opening 38 is placed upon pivot pin 34, pivot pin 39 pushes tongue 42 towards sheet 40. When fitting 4 is moved towards pivot pin 34, bearing recess 32 receives the head 60 of fixed pivot pin 34. Accordingly, tongue 42 returns to its initial pre-placement position, as illustrated in FIG. 4. Thus, tongue 42 prevents the pivot pin 34 from unintentionally leaving the bearing recess 32.

Referring now to FIG. 4, plate 10 is located on the outer side of door 2. In order to prevent a burglar from pressing the tongue 42 upwards and pushing the door 2 out of its swivel bearing, a wormscrew 44 is screwed from the inside of the door into the bearing portion 18, thereby contacting the upper side of the tongue 42 and preventing the tongue 42 from being tilted upwards.

If the door ever needs to be removed, wormscrew 14 may be easily removed via the inside of the door to allow tongue 42 to be pressed upwards.

The pivot pin 34 is fixed to a plate 48 of a floor bearing 35. A fixing screw 50 penetrates a bore 51 in plate 48 to fix plate 48 either to a horizontal floor frame piece 46 or directly to the floor. Plate 48, unlike plates for prior pivot pins, does not require a recess. A second fixing screw 52 penetrates a bore 53 in a fixed shaft 54 mounted in the plate 48. Fixed shaft 54 has an external thread 56. A head 60 having an internal thread 58 is screwed onto the external thread 56. Bearing recess 32 receives head 60.

The height of the pivot pin 34 and thus of door 2 is adjusted by turning head 60 on external thread 56. To maintain the desired height, an O-ring 62 is provided as a rotation restraint member between the internal thread 58 and the external thread 56. O-ring 62 fits into a peripheral annular groove 64 of fixed shaft 54.

An annular bearing member 68 is mounted on head 60. Bearing member is supported by a ball bearings 66 and rotatable about the axis of the pivot pin 34. Bearing member 68 supports the base 70 of the bearing recess 32. A split pin 72 is provided on the upper side of head 60 for securing the bearing body 68 to head 60. Thus pivot pin 34 provides an axis of rotation to allow door 2 to be opened and closed.

What is claimed is:

1. A door mounting comprising:

a fitting member for receiving a vertical edge of a door, said fitting member having a first recess;

an insert member provided within said first recess, said insert member having a second recess that is accessible via a first opening provided in a vertical wall being at a right angle to said vertical edge of said door, and a second opening in a horizontal wall of said insert member, said first and second openings being contiguous, wherein said second recess is configured to receive a pivot pin such that said pivot pin can move horizontally within said insert member;

a pivot pin inserted into said second recess; and an abutment member provided on a wall of said insert member, a portion of said abutment member extending into said second recess through said first opening in said vertical wall of said insert member, whereby said portion of said abutment moves from an initial position upon insertion of said pivot pin through said opening in said vertical wall of said insert member, said portion returning to said initial position after insertion to secure said pivot pin within said second recess.

2. A door mounting according to claim 1, further comprising a plate upon which said pivot pin is mounted.

3. A door mounting according to claim 1, wherein said pivot pin comprises a shaft provided with an external thread for receiving an internal thread of a head member, said head member extending into said second recess.

4. A door mounting according to claim 1, wherein said pivot pin comprises a bearing member which is rotatable about the vertical axis of said pivot pin, said bearing member being supported by a ball-bearing and engaging said insert member within said second recess.

5. A door mounting comprising:

a fitting member for receiving a vertical edge of a door, said fitting member having a first recess;

an insert member provided within said first recess, said insert member having a second recess that is accessible via a first opening provided in a vertical wall and a second opening in a horizontal wall of said insert member, said first and second openings being contiguous, wherein said second recess is configured to receive a pivot pin such that said pivot pin can move horizontally within said insert member;

an abutment member provided on a wall of said insert member, a portion of said abutment member extending into said second recess through said first opening in said vertical wall of said insert member;

a pivot pin inserted into said second recess, whereby said portion of said abutment moves from an initial position upon insertion of said pivot pin through said opening in said vertical wall of said insert member, said portion returning to said initial position after insertion to secure said pivot pin within said second recess; and an adjustable locking member which secures said portion of said abutment member in said initial position.

6. A door mounting according to claim 5, further comprising a plate upon which said pivot pin is mounted.

7. A door mounting according to claim 5, wherein said pivot pin comprises a bearing member which is rotatable about the vertical axis of said pivot pin, said bearing member being supported by a ball-bearing and engaging said insert member within said second recess.

8. A door mounting comprising:

a fitting member for receiving a vertical edge of a door, said fitting member having a first recess;

an insert member provided within said first recess, said insert member having a second recess that is accessible via a first opening provided in a vertical wall and a second opening in a horizontal wall of said insert member, said first and second openings being contiguous, wherein said second recess is configured to receive a pivot pin such that said pivot pin can move horizontally within said insert;

an abutment member provided on a wall of said insert member, a portion of said abutment member extending into said second recess through said first opening in said vertical wall of said insert member;

a pivot pin inserted into said second recess, whereby said portion of said abutment moves from an initial position upon insertion of said pivot pin through said opening in said vertical wall of said insert member, said portion returning to said initial position after insertion to secure said pivot pin within said second recess, wherein said pivot pin comprises a shaft provided with an external thread for receiving an internal thread of a head member, said head member extending into said second recess; and a rotation-restraint member provided between said internal thread and said external thread to inhibit rotation of said head member on said shaft.

9. A door mounting according to claim 8, further comprising a plate upon which said pivot pin is mounted.

10. A door mounting according to claim 8, further comprising an adjustable locking member which secures said portion of said abutment member in said initial position.

11. A door mounting according to claim 8, wherein said pivot pin comprises a bearing member which is rotatable about the vertical axis of said pivot pin, said bearing member being supported by a ball-bearing and engaging said insert member within said second recess.

* * * * *